US006897817B2

(12) United States Patent
Jo et al.

(10) Patent No.: US 6,897,817 B2
(45) Date of Patent: May 24, 2005

(54) INDEPENDENTLY TUNABLE MULTIBAND MEANDERLINE LOADED ANTENNA

(75) Inventors: Young-Min Jo, Rockledge, FL (US); Frank M. Caimi, Vero Beach, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/686,903

(22) Filed: Oct. 16, 2003

(65) Prior Publication Data

US 2004/0125031 A1 Jul. 1, 2004

Related U.S. Application Data

(60) Provisional application No. 60/420,214, filed on Oct. 22, 2002.

(51) Int. Cl.[7] ..... H01Q 1/24

(52) U.S. Cl. ..... 343/702; 343/846

(58) Field of Search ..... 343/702, 700 MS, 343/895, 846, 741, 742, 744

(56) References Cited

U.S. PATENT DOCUMENTS

| | | | | |
|---|---|---|---|---|
| 5,313,216 | A | 5/1994 | Wang et al. | 343/700 MS |
| 6,137,453 | A | 10/2000 | Wang et al. | 343/895 |
| 6,489,925 | B2 | 12/2002 | Thursby et al. | 343/700 MS |
| 6,492,953 | B2 | 12/2002 | Apostolos | 343/744 |
| 6,573,869 | B2 * | 6/2003 | Moore | 343/702 |
| 6,590,543 | B1 | 7/2003 | Apostolos | 343/742 |

* cited by examiner

*Primary Examiner*—Hoang V. Nguyen
(74) *Attorney, Agent, or Firm*—John L. DeAngelis, Jr.; Beusse Brownlee Wolter Mora & Maire, P.A.

(57) ABSTRACT

An antenna for transmitting and receiving radio frequency energy. The antenna comprises a conductive top plate formed in the shape of a spiral. In one embodiment a sidewall meanderline extends from an edge of the top plate in the direction of a ground plane. A shorting meanderline connects the top plate and the ground plane. A first region of the top plate overlies the ground plane. A second region of the top plate extends beyond the ground plane. Tuning is provided by adjusting the length and other dimensions of the meanderlines.

49 Claims, 3 Drawing Sheets

INDEPENDENTLY TUNABLE MULTIBAND MEANDERLINE LOADED ANTENNA

This application claims the benefit of the Provisional Patent Application filed on Oct. 22, 2002, and assigned application No. 60/420,214.

FIELD OF THE INVENTION

The present invention is directed generally to antennas for receiving and transmitting radio frequency signals, and more particularly to such antennas operative in multiple frequency bands.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity, signal polarization and the radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted or received. Quarter wavelength and half wavelength antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). Smaller packaging of state-of-the-art communications devices, such as handsets, does not provide sufficient space for the conventional quarter and half wavelength antenna elements. Thus physically smaller antennas operating in the frequency bands of interest and providing the other desired antenna-operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=(βR)^2+2βR, where R is the radius of the sphere containing the antenna and β is the propagation factor. Increased gain thus requires a physically larger antenna, while users continue to demand physically smaller antennas. As a further constraint, to simplify the system design and strive for minimum cost, equipment designers and system operators prefer to utilize antennas capable of efficient multi-band and/or wide bandwidth operation, to allow the communications device to access various wireless services operating within different frequency bands or such services operating over wide bandwidths. Finally, gain is limited by the known relationship between the antenna operating frequency and the effective antenna length (expressed in wavelengths). That is, the antenna gain is constant for all quarter wavelength antennas of a specific geometry i.e., at that operating frequency where the effective antenna length is a quarter of a wavelength of the operating frequency.

One basic antenna commonly used in many applications today is the half-wavelength dipole antenna. The radiation pattern is the familiar donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics.

The well-known patch antenna provides directional hemispherical coverage with a gain of approximately 4.7 dBi. Although small compared to a quarter or half wavelength antenna, the patch antenna has a relatively narrow bandwidth.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength decreases/increases and the antenna element dimensions proportionally decrease/increase.

Thus antenna designers have turned to the use of so-called slow wave structures where the structure physical dimensions are not equal to the effective electrical dimensions. Recall that the effective antenna dimensions should be on the order of a half wavelength (or a quarter wavelength above a ground plane) to achieve the beneficial radiating and low loss properties discussed above. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\epsilon_r)\mathrm{sqrt}(\mu_r))=\lambda f$. Since the frequency remains unchanged during propagation through a slow wave structure, if the wave travels slower (i.e., the phase velocity is lower) than the speed of light, the wavelength within the structure is lower than the free space wavelength. Thus, for example, a half wavelength slow wave structure is shorter than a half wavelength structure where the wave propagates at the speed of light (c). The slow-wave structure de-couples the conventional relationship between physical length, resonant frequency and wavelength. Such slow wave structures can be used as antenna elements or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole, for instance, then the structure propagating the slow wave will be physically smaller than the structure propagating the wave at the speed of light.

BRIEF SUMMARY OF THE INVENTION

In one embodiment, an antenna of the present invention is configured for connection in a spaced-apart relation to a ground plane for transmitting and receiving radio frequency energy, comprising. The antenna comprises a spiral-shaped top plate bounded by one or more edges. A shorting element (in a preferred embodiment comprising a meanderline conductor) extends from the top plate in the direction of the ground plane for electrically connecting the top plate to the ground plane. A sidewall extends from a top plate edge in the direction of the ground plane.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
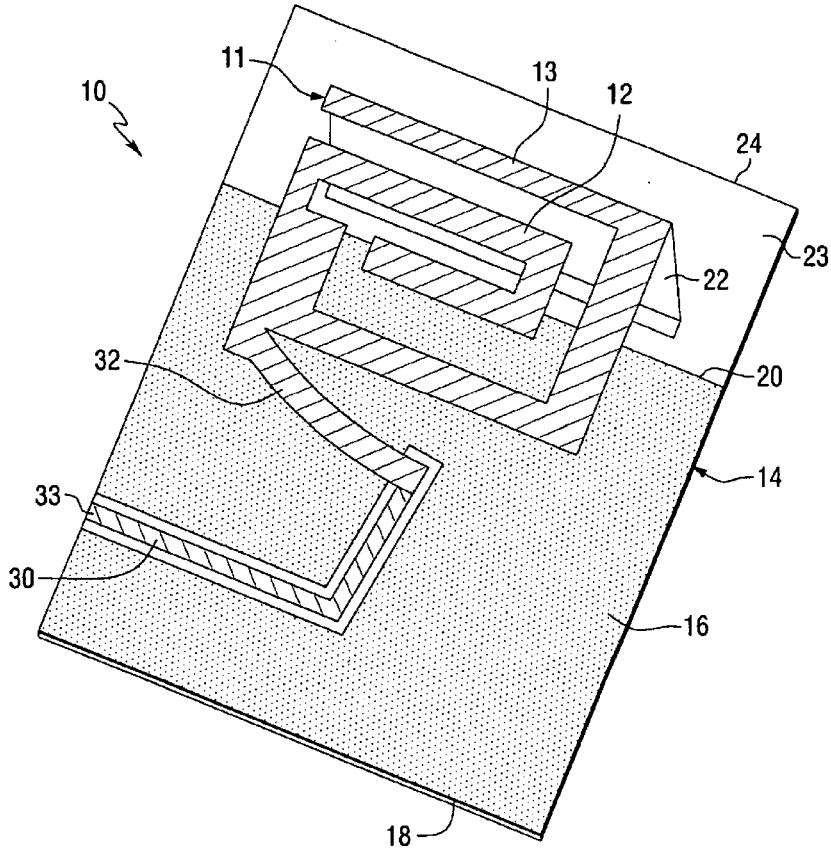
FIG. 1 is perspective view of an antenna constructed according to the teachings of the present invention.

Before describing in detail the particular antenna apparatus of the present invention, it should be observed that the present invention resides primarily in a novel and non-obvious combination of elements. Accordingly, the inventive elements have been represented by conventional elements in the drawings, showing only those specific details that are pertinent to the present invention so as not to obscure the disclosure with structural details that will be readily apparent to those skilled in the art having the benefit of the description herein.

The antenna of the present invention comprises a compact spiral shaped radiator having one or more meanderline structures connected thereto, thus providing optimum operating characteristics in a volume smaller than a quarter-wave structure above a ground plane. The antenna is easily constructed by stamping the required shape from a blank metal sheet. Certain regions of the stamping are then shaped as required and meanderline segments are affixed in the appropriate locations. The small antenna volume of the antenna allows for installation in communications device handsets and other applications where space is at a premium. In another embodiment, the antenna of the present invention can be constructed by patterning and etching a conductive sheet disposed on a dielectric substrate.

One embodiment of an antenna 10 of the present invention is illustrated in the perspective view of FIG. 1. The antenna 10 is constructed from a sheet of relatively thin conductive material (copper, for example) and comprises a top plate 11 further comprising an inner spiral segment 12 and an outer spiral segment 13. Alternatively, the top plate 11 comprises a sheet of conductive material from which material has been removed from a region proximate a center of the sheet extending to an edge of the conductive material sheet. In one embodiment, the material is removed to form a spiral slot in the top plate 11.

The antenna 10 is disposed over a dielectric substrate 14, including a ground plane 16 that extends from an edge 18 to a boundary 20 of the dielectric substrate 14. Thus the ground plane 16 does not extend beneath the entire antenna 10. This feature affects the capacitance between the top plate 11 and the dielectric substrate 14 and thus the operational characteristics of the antenna 10 as discussed further below. In one embodiment, the distance between the top plate 11 and the dielectric substrate 14 is about 5 mm. Modifying this distance changes the resonance characteristics of the antenna 10.

The antenna 10 further comprises a meanderline element 22 that rests on the dielectric substrate 14 in a region 23 between the boundary 20 and an edge 24. The meanderline element 22 is not electrically connected to the region 23, but may be mechanically connected thereto to provide support for the antenna 10.

A signal is fed to or received from the antenna 10 via a feed line trace 30 (formed on the dielectric substrate 14) and an antenna feed 32. Conventionally, a feed connector (not shown in FIG. 1) is physically attached to the dielectric substrate in a region 33, wherein the feed connector includes a feed pin for electrically contacting the feed lie trace 30, and ground pins for electrically contacting the ground plane 16. The embodiment of FIG. 1 lacks certain meanderline segments that are present in embodiments described and illustrated below.

Figure 2:
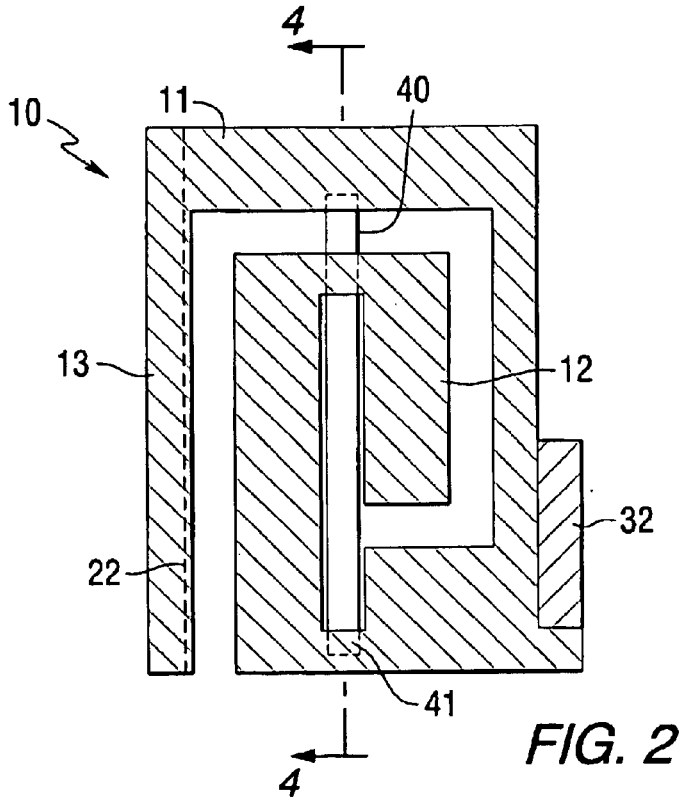
FIGS. 2 and 3 illustrate top and end views, respectively, for another embodiment of an antenna constructed according to the teachings of the present invention.
Figure 3:
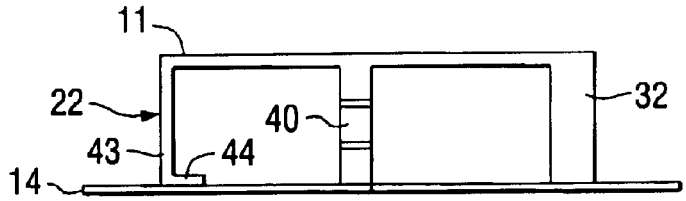

FIGS. 2 and 3 are top and front views, respectively, of another embodiment of the antenna 10, comprising meanderline elements 22 and 40 (the latter is not shown in FIG. 1). The meanderline element 40 is electrically connected between a region 41 of the top plate 11 and the ground plane 16. As best illustrated in FIG. 3, the meanderline element 22 comprises a vertical segment 43 and an arm 44 extending therefrom and disposed in physical contact with the region 23 of the dielectric substrate 14; the arm 44 is not electrically connected to the ground plane 16.

Figure 4:
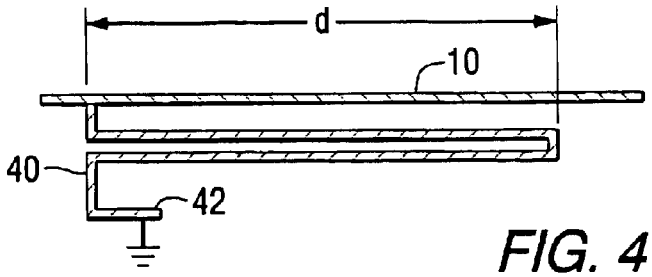
FIG. 4 illustrates a cross-sectional view of a meanderline element of the antenna depicted in FIGS. 2 and 3.

One preferred configuration of the meanderline element 40 is shown in the cross-sectional illustration of FIG. 4, taken along the plane 4—4 of FIG. 2. As schematically indicated, an end 42 of the meanderline element 40 is connected to ground. In one embodiment, the distance "d" is about 1 inch.

Figure 5:
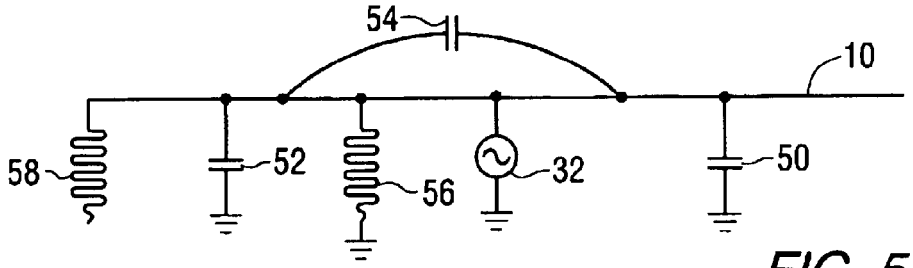
FIG. 5 is an equivalent electrical schematic of the antenna of FIGS. 2 and 3.

An equivalent electrical circuit of the antenna 10 is illustrated in FIG. 5. A capacitor 50 represents the capacitance between the outer spiral segment 13 and the ground plane 16. A capacitor 52 represents the capacitance between the inner spiral segment 12 and the ground plane 16. Both of the capacitors 50 and 52 are affected by the vertical distance between the top plate 11 and the ground plane 16. Also, as the boundary 20 (see FIG. 1) is adjusted with respect to the antenna edge 18 (or the edge 24) the capacitors 50 and 52 change in value. Thus one technique for effecting these capacitances, and the antenna characteristics generally, is to adjust the distance between the boundary 20 and the edge 18 (or the edge 24).

A capacitor 54 represents the capacitance between the inner and the outer spiral segments 12 and 13, respectively. A symbol 56 represents the meanderline element 40 shorted to ground. The meanderline element 22 is represented by a symbol 58, which is not connected to ground but instead is indicated as open. Generally, as they are illustrated in FIG. 5, the elements to the right of the antenna feed 32 affect low frequency band performance and the elements to the left of the antenna feed 32 affect the high frequency band performance.

In one embodiment, the antenna 10 operates or presents resonant operation in the cellular frequency band of about 880–960 MHz (the low band) and the in the personal communications systems band of about 1.710–1.990 GHz (the high band). The radiation pattern in the low band is omnidirectional (the familiar donut pattern) and in the high band is primarily elevational, that is, the energy is primarily radiated in the elevation direction. The high band frequency is tunable by adjusting the physical characteristics of the meanderline element 40, such as the length thereof, to, for example, achieve resonance in the band around 1.5 GHz, the global positioning system frequency band. The shape and dimensions of the meanderline element 22 can also be varied to effect a change in the performance characteristics, including the operating frequency, of the antenna 10.

In one embodiment, the approximate dimensions of the antenna 10 are a length of about 0.4 inches and a width of about 0.4 inches.

Figure 6:
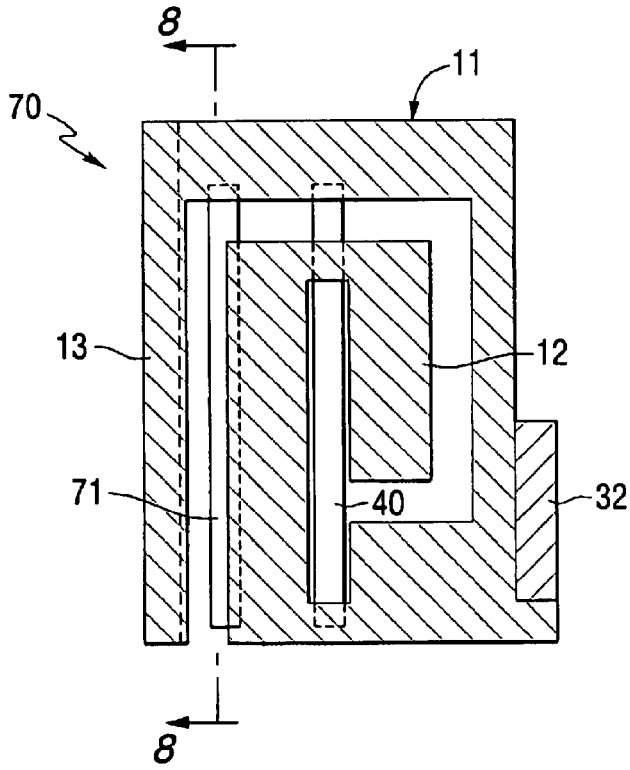
FIGS. 6–8 illustrate various views of a second embodiment of an antenna constructed according to the teachings of the present invention.

A top view of an antenna 70 presenting a resonant condition in three frequency bands is illustrated in FIG. 6. Generally, the antenna 70 includes the inner spiral segment 12 and the outer spiral segment 13 as illustrated in FIG. 1 for the antenna 10. However, the antenna 70 further comprises additional and modified meanderline elements when compared with the antenna 10.

Figure 7:
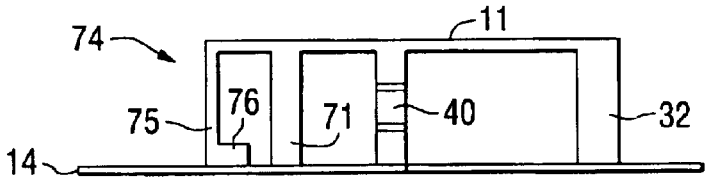

A front view of the antenna 70 is illustrated in FIG. 7. The antenna 70 includes the meanderline element 40 and the antenna feed 32, which operate in substantially the same manner as described above in conjunction with the antenna 10. The antenna 70 further comprises a meanderline element 71, comprising electrically connected segments 72 and 73. The segment 72 extends from the top plate 11 and the segment 73 is disposed on or proximate the dielectric substrate 14, but is not electrically connected to the ground plane 16.

Figure 8:
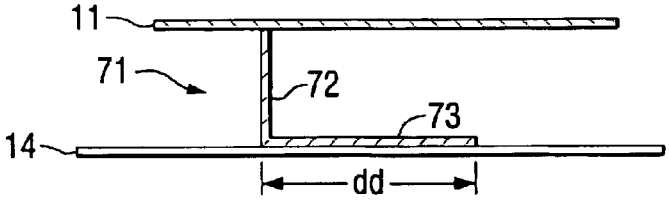

The meanderline element 71 is further illustrated in the cross-sectional view of FIG. 8, which is taken along the plane 8—8 of FIG. 6. As shown, the meanderline element 71 is disposed on the dielectric substrate 14, but is not electrically connected to the ground plane 16. In one embodiment the distance dd is about 0.3 inches.

The antenna 70 further comprises a meanderline element 74, comprising a vertical segment 75 and an arm 76.

In operation the antenna 70 presents a resonant condition in the 820–890 MHz band for cellular communications, in the 1.5 GHz band for global positioning systems (GPS) communications and in the 2.5 GHz band for wireless local area network communications.

Generally, according to the teachings of the present invention, the antenna presented generally in FIG. 1 can be tuned to operate in various frequency bands by adding meanderline elements, and/or adjusting the length of the illustrated meanderline elements. Additional operative frequency bands can be created by adding meanderline elements. By adjusting only certain of the meanderline elements operation in one frequency band can be modified without affecting operation in other bands. Thus the antenna offers separately tunable operational frequency bands. In prior art antennas it is known that changing one antenna physical characteristic or dimension typically affects all the resonant frequencies of the antenna. The antenna of the present invention is not so limited. Also, scaling the dimensions of the antenna of the present invention (e.g., length, width, height above the ground plane) generally affects all the resonant frequencies.

An antenna architecture has been described as useful for providing operation in one or more frequency bands. While specific applications and examples of the invention have been illustrated and discussed, the principals disclosed herein provide a basis for practicing the invention in a variety of ways and in a variety of antenna configurations. Numerous variations are possible within the scope of the invention. The invention is limited only by the claims that follow.

What is claimed is:

1. An antenna for connecting to an underlying ground plane for transmitting and receiving radio frequency energy, comprising;

a spiral-shaped top plate bounded by one or more edges;

a shorting element extending from the top plate in the direction of the ground plane for electrically connecting the top plate to the ground plane; and a sidewall extending from a top plate edge in the direction of the ground planed, wherein the sidewall is not disposed over the ground plane.

2. The antenna of claim 1 wherein only a portion of the top plate overlies the ground plane when the antenna is operative with the ground plane.

3. The antenna of claim 2 wherein an area of the portion of the top plate overlying the ground plane is adjustable to affect antenna performance.

4. The antenna of claim 2 wherein the portion of the top plate overlying the ground plane includes a first region of the top plate from which the shorting element extends and excludes a second region of the top plate from which the sidewall extends.

5. The antenna of claim 1 wherein the ground plane comprises a conductive material disposed on a first region of the substrate and conductive material is absent from a second region of the substrate, and wherein the sidewall is disposed overlying the second region.

6. The antenna of claim 1 wherein the top plate comprises an inner spiral segment connected to an outer spiral segment.

7. The antenna of claim 1 wherein the top plate comprises a continuous spiral formed from a conductive material.

8. The antenna of claim 1 wherein the shorting element comprises a meanderline conductor.

9. The antenna of claim 8 wherein the meanderline conductor comprises an elongated transmission line having a zigzag configuration.

10. The antenna of claim 8 wherein the meanderline conductor comprises an elongated transmission line further comprising a first segment and a second segment, and wherein the first and the second segments are electrically connected and disposed substantially parallel to the top plate.

11. The antenna of claim 10 mounted overlying the ground plane, wherein the first and the second segments are substantially parallel to the ground plane and are disposed between the top plate and the ground plane.

12. The antenna of claim 1 further comprising a feed element connected to the top plate.

13. The antenna of claim 1 further comprising a feed element, wherein the top plate comprises an inner spiral segment and an outer spiral segment, and wherein the feed element is disposed at a terminal end of the outer spiral segment.

14. The antenna of claim 13 overlying a dielectric substrate further comprising a ground plane and a conductive feed region insulated from the ground plane, wherein the feed region is electrically connected to the feed element.

15. The antenna of claim 14 wherein the feed element comprises a conductive strip extending from the top plate to the conductive feed region on the dielectric substrate.

16. The antenna of claim 1 wherein the sidewall forms a substantially right angle with the top plate edge.

17. An antenna comprising:

a ground plane;

a spiral top plate further comprising first and second regions, wherein the first region overlies the ground plane;

a feed element in electrical communication with the top plate;

a first meanderline conductor extending from the top plate; and a second meanderline conductor extending from the top plate.

18. The antenna of claim 17 wherein the ground plane comprises a dielectric substrate having conductive material disposed on a first region thereof, and wherein conductive material is absent from a second region of the substrate, and wherein a first region of the top plate substantially overlies the first region of the substrate.

19. The antenna of claim 18 wherein the first meanderline conductor extends from the first region of the top plate and further comprises an elongated conductor in a zigzag configuration, and wherein the first meanderline conductor connects the top plate to the ground plane.

20. The antenna of claim 17 wherein the top plate further comprises a second region extending beyond an edge of the ground plane, and wherein the second meanderline conductor comprises a first conductive element extending from an edge of the second region and a second conductive element extending from the first conductive element.

21. The antenna of claim 20 wherein an angle formed between the first conductive element and the second region of the top plate is about 90°.

22. The antenna of claim 20 wherein an angle formed between the first conductive element and the second conductive element is about 90°.

23. An antenna for connecting to a spaced-apart ground plane for transmitting and receiving radio frequency energy, comprising;

a spiral-shaped top plate having one or more edges;

a sidewall extending from a top plate edge in a direction toward the ground plane; and wherein when operative with the ground plane a first region of the top plate is disposed opposite the ground plane and a second region of the top plate extends beyond an edge of the ground plane.

24. The antenna of claim 23 wherein the sidewall extends beyond the edge of the ground plane.

25. The antenna of claim 24 further comprising a shorting element for electrically connecting the top plate to the ground plane.

26. The antenna of claim 25 wherein the shorting element comprises a meanderline conductor extending from the top plate.

27. The antenna of claim 23 further comprising a dielectric substrate having first and second substrate regions, wherein the ground plane is disposed on the first substrate region, and wherein the first top plate region is disposed opposite the first substrate region.

28. The antenna of claim 27 wherein the sidewall overlies the second substrate region.

29. An antenna for connection to a ground plane for transmitting and receiving radio frequency energy, comprising;

a spiral-shaped top plate;

a first meanderline element extending from the top plate in a direction of the ground plane for interconnecting the top plate to the ground plane;

a second meanderline element extending from the top plate; and a sidewall extending from an edge of the top plate.

30. The antenna of claim 29 wherein a distance between the top plate and the ground plane is selected to achieve desired performance parameters for the antenna.

31. The antenna of claim 29 wherein a region of the top plate overlaps the ground plane when the antenna is configured for operation with the ground plane.

32. The antenna of claim 31 wherein an area of the overlapping region is adjustable to modify performance characteristics of the antenna.

33. The antenna of claim 32 wherein the first meanderline element is disposed in the overlapping region.

34. The antenna of claim 29 wherein the top plate comprises an inner spiral segment in electrical communications with an outer spiral segment.

35. The antenna of claim 29 wherein the top plate comprises a continuous spiral formed from conductive material.

36. The antenna of claim 29 wherein the second meanderline element extends from the top plate in the direction of the ground plane and comprises a substantially L-shaped meanderline element.

37. The antenna of claim 36 wherein the second meanderline element further comprises a first segment extending from the top plate and a second segment extending from the first segment, and wherein a length of the second segment is less than a length and a width of the top plate.

38. The antenna of claim 29 wherein the first meanderline element comprises an elongated meanderline transmission line including a segment substantially parallel to the top plate.

39. The antenna of claim 29 wherein the first meanderline element comprises an elongated transmission line further comprising at least two connected segments substantially parallel to the top plate.

40. The antenna of claim 29 mounted in a spaced-apart relation to the ground plane, wherein the first meanderline element comprises two substantially parallel elongated segments oriented substantially parallel to the ground plane and substantially parallel to the top plate.

41. The antenna of claim 29 further comprising a feed element.

42. The antenna of claim 41 wherein the feed element extends from the top plate in a the direction of the ground plane, and wherein the ground plane is disposed on a dielectric substrate, and wherein the dielectric substrate comprises a conductive feed region insulated from the ground plane and for electrical connection to the feed element.

43. The antenna of claim 29 wherein the second meanderline element is oriented between the sidewall and the first meanderline element.

44. The antenna of claim 29 wherein the sidewall comprises a first segment disposed at a substantially right angle from the top plate and a second segment connected to the first segment and disposed at substantially a right angle from the first segment.

45. An antenna for connecting to a spaced-apart ground plane for transmitting and receiving radio frequency energy, comprising;

a conductive sheet defining a slot therein, wherein the sheet further comprises one or more edges and a first and a second region thereof;

a sidewall extending from a sheet edge in a direction toward the ground plane when the antenna is operative with the ground plane; and wherein when operative with the ground plane the first region is disposed opposite the ground plane and the second region extends beyond an edge of the ground plane.

46. The antenna of claim 45 wherein the sidewall extends from the second region.

47. The antenna of claim 24 further comprising a shorting element extending from the first region for electrically connecting the top plate to the ground plane.

48. The antenna of claim 46 wherein the slot defines a spiral shape.

49. An antenna for connecting to a spaced-apart ground plane for transmitting and receiving radio frequency energy, comprising:

a radiating element defining a slot therein, bounded by one or more edges and comprising a first portion and a second portion;

a shorting element extending from the radiating element in the direction of the ground plane for electrically connecting the radiating element to the round plane; and wherein the first portion overlies the ground plane and the second portion extends beyond the ground plane.

* * * * *